United States Patent [19]

Birnbaum

[11] 4,236,093

[45] Nov. 25, 1980

[54] SPEED INSENSITIVE WHEEL DETECTOR

[75] Inventor: David Birnbaum, Pittsford, N.Y.

[73] Assignee: General Signal Corporation, Stamford, Conn.

[21] Appl. No.: 907,088

[22] Filed: May 18, 1978

[51] Int. Cl.[3] ..... H02K 21/38

[52] U.S. Cl. ..... 310/155; 246/249; 310/118

[58] Field of Search ..... 310/168, 155, 152; 246/249

[56] References Cited

U.S. PATENT DOCUMENTS

| | | | |
|---|---|---|---|
| 3,697,745 | 10/1972 | Bolton | 246/249 |
| 3,780,313 | 2/1973 | Wiegand | 310/168 X |

OTHER PUBLICATIONS

"Wiegand Wire: New Material for Magnetic-Based Devices", Electronics, 7/10/75, pp. 100–105.

*Primary Examiner*—Donovan F. Duggan

*Attorney, Agent, or Firm*—Milton E. Kleinman; George W. Killian

[57] ABSTRACT

An apparatus for detecting the presence and/or direction and/or velocity of a moving ferromagnetic element is provided. A sensing coil is placed in coupling relationship with a bi-stable ferromagnetic wire to provide a signal in response to a change in polarity of the core of the bi-stable wire. The core polarity changes in response to element presence as the element constitutes a magnetic shunt causing a change in magnetic flux density and/or direction in the air gap of a magnetic circuit in which the bi-stable wire is situated. The sensor is substantially insensitive to element velocity. Modified structures provide for fail-safe operation.

14 Claims, 5 Drawing Figures

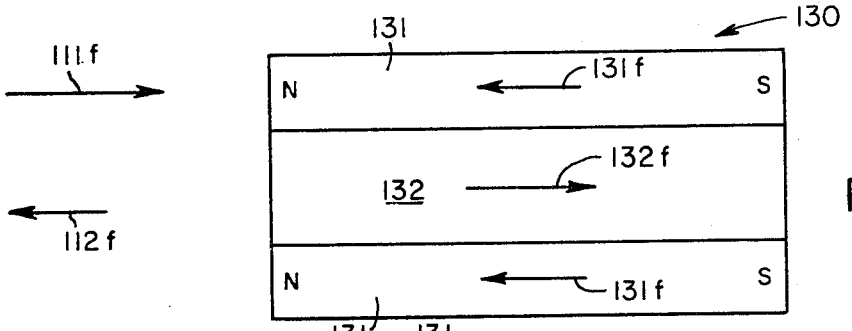
FIG. 3
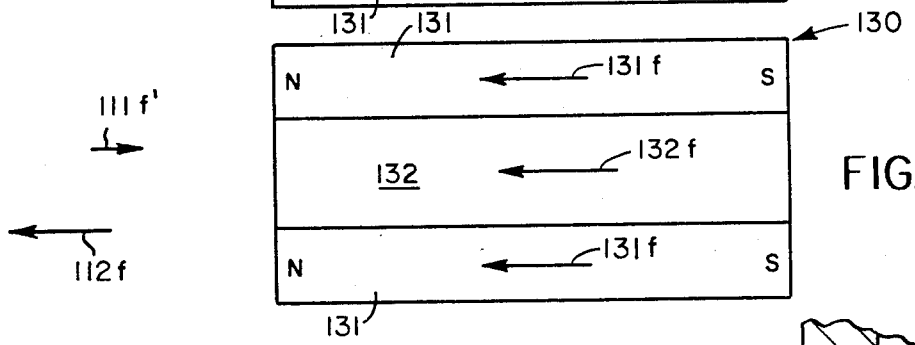
FIG. 4
FIG. 5
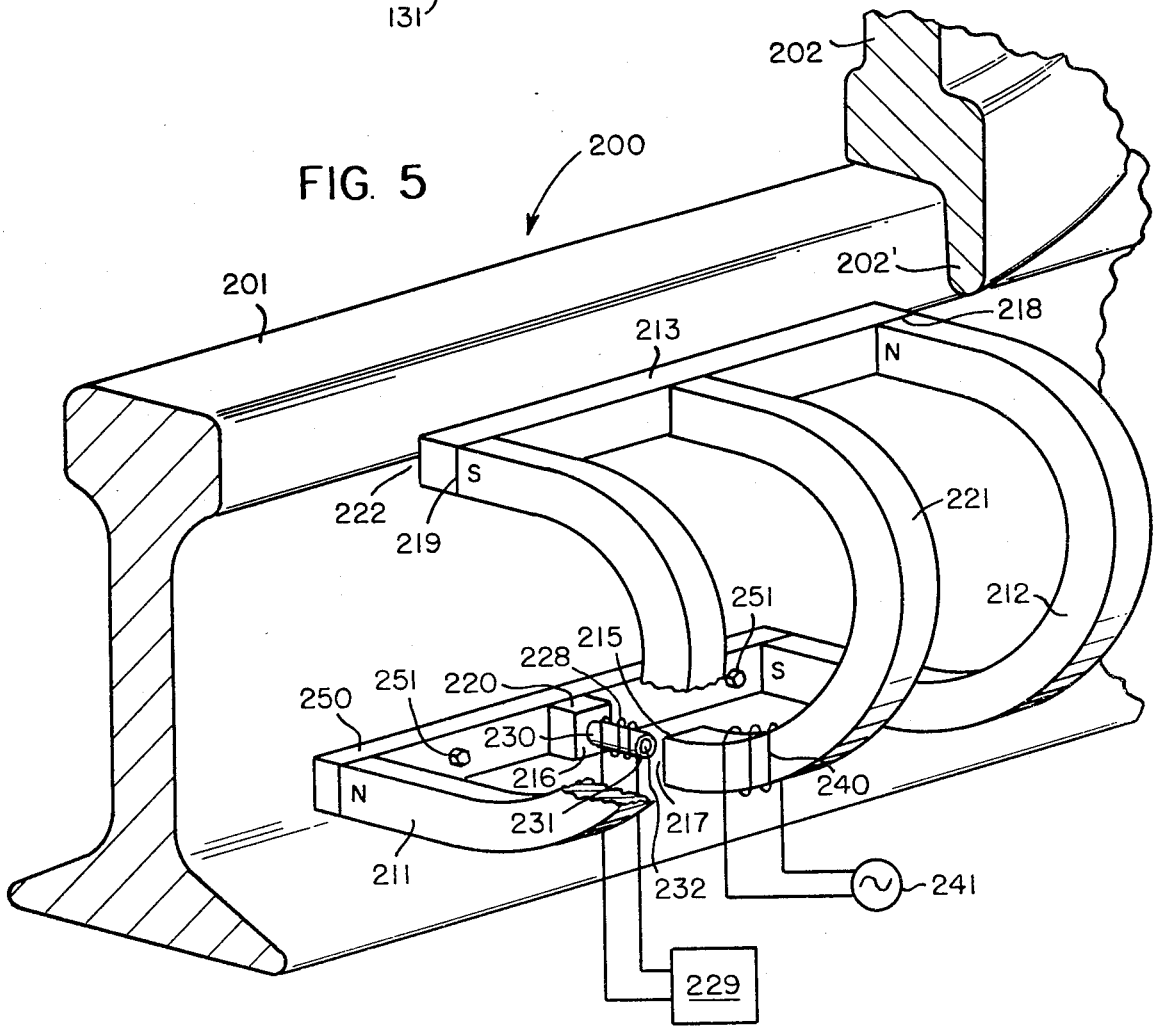

SPEED INSENSITIVE WHEEL DETECTOR

BACKGROUND OF THE INVENTION

In this technological world it is often considered desirable to be able to detect and respond to elements passing a predetermined location. Numerous examples exist in traffic control wherein it may be desired to identify the number of vehicles passing a given intersection and/or to determine the number of vehicles waiting to enter a given intersection. Devices may also be used to count people as they enter and/or leave a given location; to count manufactured articles coming down an assembly line; to identify unauthorized motion in a protected area; and a wide variety of other applications which are familiar to those acquainted with the applicable arts.

A wide variety of techniques have been employed in the design and operation of such devices. For example, light beams and photodetector cells have been employed; weight detectors are frequently used; light reflecting devices are used, and in applicable situations, the presence of an article may be detected due to its effect on a magnetic field.

The structure to be described herein is of the class whose presence is detected in response to the effect that the object has on a magnetic field. Although the techniques and structures disclosed and described herein obviously have more general utility, they are specifically described in a railroad setting wherein it is desired to be able to detect and respond to the presence and/or passage of a railroad wheel passing a predetermined location. Detecting changes in magnetic field strength in response to the presence or absence of a train wheel is not broadly new, and a substantial number of devices and techniques have been developed for this purpose. Examples of prior devices employing a magnetic circuit may be seen in the Smith U.S. Pat. No. 3,562,603 or the Bolton U.S. Pat. No. 3,697,745 issued Feb. 9, 1971 and Oct. 10, 1972, respectively, and assigned to the same assignee as the present application. A related device for responding to detection signals is shown in the Auer U.S. Pat. No. 3,601,664 issued Aug. 24, 1971 and assigned to the same assignee as the present application.

These devices may be used in the railroad industry for a wide variety of purposes. For example, with associated equipment, they may be used to detect a train entering a station and provide a signal of where to stop so that the cars are in the most propitious location. They may also be used in a switch yard to count cars and assist in the makeup of a train and/or to prevent placing too many cars on a specific track. Detectors are sometimes used in pairs, spaced apart a known distance so that the time differential in triggering the two detectors may be used to calculate train speed and/or direction of motion. Detectors may also be used to identify a train approaching a grade crossing in order to provide suitable warning signals. Other applications in the railroad industry will readily occur to those with appropriate training and experience; and those with other training and experience will be able to identify utility in their art.

DESCRIPTION OF THE PRIOR ART

The use of ferromagnetic rails and wheels in the railroad art has made it natural to use magnetic techniques for detecting the presence and/or passage of a train at a given location. Convenient and economical magnetic circuits have been developed which are rugged, reliable, virtually insensitive to temperature and weather conditions, not significantly influenced by shock or vibration, and which do not require critical power supplies. Accordingly, magnetic detection techniques have become widely accepted industry standards. However, some type of transducer is required to detect and respond to the changing magnetic field in order to provide a suitable control signal which in turn may be used to operate counters, provide signal lights, control speed, and any of a wide variety of other functions well known to those familiar with the art. A wide variety of transducers have been used, but none are ideal for utility under the full range of environmental conditions that are encountered in railroad applications. Magnetically responsive switches, commonly referred to as Reed switches, have found considerable acceptance, but the industry has long desired a more rugged structure which is less sensitive to vibration and shock. Thus, there has been a need for a technique to respond to a changing magnetic field that will not only meet the rigors of railroad operation, but also be simple, economical and reliable. Furthermore, the desired characteristics should be provided without requiring elaborate power supplies and should provide a substantially identical response irrespective of the velocity of the train wheel passing the detecting point.

SUMMARY OF THE INVENTION

While the invention described herein may have broad utility, its structure and function will be described in a railroad application wherein it is used to detect the presence of a railroad wheel entering or exiting an identified location. The apparatus comprises a magnetic structure, such as a magnetic bridge, which causes a change to take place in the magnitude and/or direction of magnetic flux between spaced apart faces of pole pieces in response to the presence of the ferromagnetic wheel of a train which alters the path of the magnetic flux in the magnetic circuit. Placed between the faces of the pole pieces is a bi-stable ferromagnetic transducer comprising a ferromagnetic wire having a core portion and an outer shell portion of relatively low and high coercivity, respectively. The magnetic circuit is so designed that the presence of a train wheel will cause a reversal of magnetic flux between the faces of the pole pieces and, in response thereto, the magnetic polarity of the core of the bi-stable ferromagnetic wire is reversed. Coupled with the ferromagnetic bi-stable device is a sensing coil which responds to the magnetic polarity reversal of the core to produce an output signal. No power supply is required to produce an output signal. Modified structures are provided for fail-safe applications and/or for detecting the direction and/or velocity of wheel motion.

It is an object of the present invention to provide a new and improved detector which is of simplified and economical construction.

It is another object of the invention to provide a wheel detector which has no moving parts and which is, therefore, of improved reliability because of reduced probability of malfunction resulting from shock, vibration, or environmental hazard.

It is another object of this invention to provide a wheel detector which is insensitive to the speed of the train as it enters and/or exits the detection device.

It is another object of this invention to provide a wheel detector structure which is capable of indicating the direction and/or velocity of the moving wheel.

It is another object of this invention to provide a wheel detection structure which economically and reliably responds to a changed magnetic field resulting from the presence of a train wheel.

It is another object of this invention to provide a wheel detection structure which may be used in fail-safe applications.

BRIEF DESCRIPTION OF THE DRAWING

For better understanding of the present invention, together with other and further objects, features and advantages thereof, reference may be had to the following description taken in connection with the accompanying drawing wherein

FIG. 3 and FIG. 4 comprise an enlarged cross-section view of an element of the structure; and FIG. 5 illustrates in symbollic form the structure and assembly of another embodiment of the invention.

DESCRIPTION OF THE PREFERRED EMBODIMENT

Figure 1:
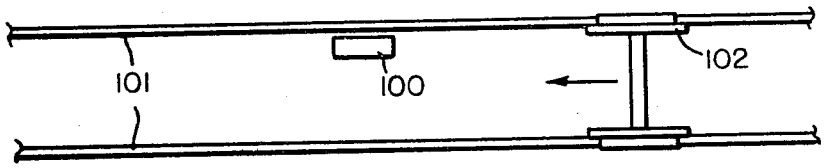
FIG. 1 is a plan view of a system incorporating the invention.

FIG. 1 illustrates the use of the detector in a railroad application wherein the detector, indicated generally as 100, is mounted adjacent to one track of a track pair 101 which comprises conventional ferromagnetic rails. The function of the detector 100 is to detect the presence of passing railroad car wheels 102 as they move into and/or out of the vicinity of the detector 100. The signal from the detector 100 may be connected to any of a wide variety of suitable apparatus (not shown) for initiating appropriate operations such as counting, providing speed and/or direction indication, activating warning devices and/or any other purposes for which wheel detectors are customarily employed.

Figure 2:
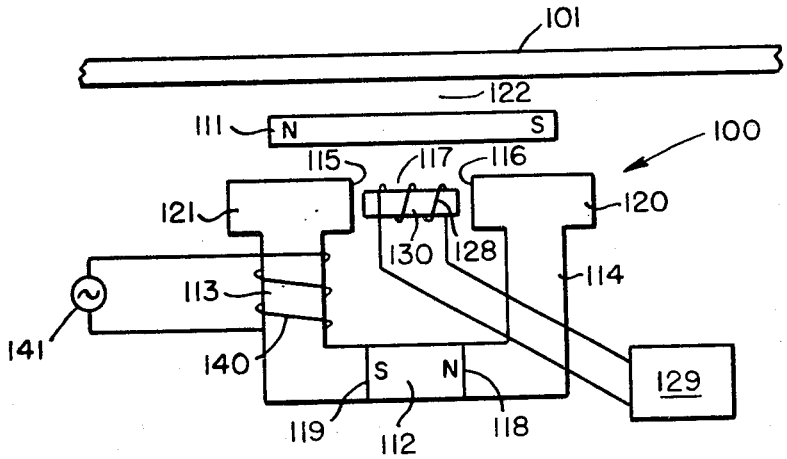
FIG. 2 is a schematic representation of the essential elements of one embodiment of the structure.

The elements of the wheel detector 100 are more completely, but symbolically, represented in FIG. 2. As may be seen, the wheel detector 100 is situated near one of the rail members 101 and although it is more common practice to situate the detector 100 on the inside, or flange side, of the rail 101, it is possible to design structures which may be used on the other side of the rail 101. The detector 100 includes a housing, a magnetic circuit including permanent or electromagnets and associated hardware. Only essential elements of the magnetic circuit are illustrated schematically inasmuch as magnetic circuits are well known and a wide variety of suitable structures can be implemented. The essential elements of the detector 100 include a first magnet 111 and a second magnet 112. The first permanent magnet 111 is spaced apart from, but substantially parallel with the rail 101. The second permanent magnet 112 is associated with pole pieces 113 and 114 which have respective pole faces 115 and 116. It will be evident that the magnets 111 and 112 could comprise electromagnets, however, the use of permanent magnets provides a system independent of external power supplies. With the magnet 112 polarized with the north pole on the right hand and the south pole on the left hand, it will be obvious that conventional magnetic flux may be considered to flow from the north magnetic pole of the magnet 112 and in a counterclockwise direction through the pole piece 114 and out of the pole face 116 and across the gap 117 to pole face 115 and thence through the pole piece 113 to return to the south pole of the magnet 112. The flux density in the air gap 117 between pole faces 115 and 116 will, of course, be a function of several factors including the magnetic strength of the magnet 112, the cross-section shape and size of the pole pieces 113 and 114 as well as that of the pole faces 115 and 116 and/or surrounding ferromagnetic members. In addition, the flux density between the pole faces 115 and 116 may be controlled by any of a variety of methods including an adjustable magnetic shunt between the north and south poles of the magnet 112 and/or an adjustable space 118 or 119 between the north and south magnetic poles of the magnet 112 and the respective pole pieces 114 and 113.

Considering now more specifically the permanent magnet 111, it will be seen to have a north pole at the left end and a south pole at the right end. If the rail 101 and the pole pieces 113 and 114 comprise the closest ferromagnetic elements, it will be evident that the magnetic flux emanating from the north pole of magnet 111 and returning to the south pole of magnet 111 will pass through air gaps for a significant portion of their travel. However, ferromagnetic substances present greatly reduced reluctance to the flow of magnetic flux and, therefore, a substantial portion of the flux will be concentrated in the rail 101 and another substantial portion of the flux from the magnet 111 will be concentrated in the upper portions 121 and 120 of the pole pieces 113 and 114. More specifically, a portion of the magnetic flux emanating from the north pole of magnet 111 will pass from left to right through upper portion 121 of pole piece 113 and out the pole face 115 across the air gap 117 to the pole face 116 to the upper portion 120 of pole piece 114 and then return through an air gap to the south pole of magnet 111.

From the foregoing, it will be observed that the permanent magnet 112 causes a magnetic flux to pass from right to left through the air gap 117 while the permanent magnet 111 causes a magnetic flux to pass through the air gap 117 from left to right. By appropriate design techniques, with which those familiar with magnetic circuits are well acquainted, it is possible to provide a structure wherein the resultant direction and magnitude of the magnetic flux passing between pole faces 115 and 116 may be controlled and adjusted. Such controls and adjustments include magnetic strength, pole piece design, composition, size and shape, magnitude of spaces or gaps 118 and 119, proximity of other magnetic elements including the magnitude of the space 122 separating magnet 111 and the rail 101.

Returning now for a moment to FIG. 1, it will be seen that if the wheel assembly 102 moves from right to left, it will approach the detector 100. If such wheel 102 is imagined as rolling along the rail 101, as shown in FIG. 2, so that the flange of the wheel 102 enters the space 122 separating the magnet 111 and the rail 101, it will be evident to those familiar with magnetic circuits that the reluctance of the magnetic path between the magnet 111 and the rail 101 will be greatly reduced and that a substantial portion of the magnetic flux emanating from the magnet 111 will pass through the portion of the wheel 102 in the space 122. This will cause a greatly reduced flux flow between the pole faces 115 and 116 resulting from the influence of the magnet 111. It will be recalled that with no wheel present, the magnets 111 and 112 are inducing flux in opposite directions between the pole faces 115 and 116. The structure is designed so that when the wheel 102 is not present, the flux generated by the magnet 111 dominates and the direction of the net flux between the pole faces 115 and 116 is from left to right. However, when a wheel 102 is present in the space 122, it provides a magnetic shunt and a substantial portion of the magnetic flux from permanent magnet 111 is diverted through the wheel 102 with the result that the magnet 112 controls the dominant flux between the pole faces 115 and 116 and the net flux between these pole faces flows from right to left. As the wheel 102 continues its motion and passes to the left, it will no longer influence the flux from magnet 111 and magnet 111 will again dominate the flux between pole faces 115 and 116 with the result that the net flux is from left to right. In summary, it must be appreciated that when no wheel is in the detector 100, the flux between the pole faces 115 and 116 is in one direction and that when a wheel is present, the flux is in another direction. Structures for providing this feature are well documented and widely used, and it is believed that further description and/or discussion is unnecessary and would only tend to obscure the novel aspects and characteristics of the structure. Accordingly, no further details concerning the magnetic structure will be provided except as is necessary to more fully describe how the detector responds to the changed flux direction.

Situated between the pole faces 115 and 116 is a bi-stable ferromagnetic wire 130 which may be manufactured in accordance with the teachings disclosed in U.S. Pat. No. 3,892,118 issued to John R. Wiegand on July 1, 1975. The named patent discloses a process for treating a ferromagnetic wire so that it is subjected to cyclical torsional strain and longitudinal strain to provide a bi-stable magnetic wire switching device having permanently different shell and core magnetic properties. The wire switches state in response to an appropriate threshold of external fields and does so without being held under external stress or strain. The bi-stable ferromagnetic wire may preferrably comprise an alloy containing approximately 52% cobalt, 10% vanadium and the balance iron. The bi-stable ferromagnetic wire element 130 used in the present structure may have a nominal diameter of the order of 0.25 mm with a length of the order of a few centimeters.

The bi-stable wire 130 is illustrated schematically as element 130 in FIG. 2. FIG. 2 also illustrates a sensing coil 128 wound in coupling relationship with the bi-stable wire 130.

In order to more fully appreciate the function of the bi-stable wire 130 in the detector 100, it is shown greatly enlarged in FIG. 3. Although the bi-stable wire 130 may have a diameter of the order of 0.25 mm and a length of only a few centimeters, it comprises an outer shell portion 131 and an inner core portion 132. As a consequence of processing the wire in the manner described in the cited Wiegand patent, the shell 131 and core 132 have different magnetic properties. More specifically, the process results in a magnetically hardened shell 131 and a magnetically softer core 132. That is to say, the shell 131 and core 132 exhibit different hysteresis characteristics and more specifically the shell 131 and core 132 have relatively high and low coercivity, respectively. If the bi-stable wire 130 is placed in a sufficiently strong magnetic field with the flux lines aligned with the wire 120, the shell 131 and core 132 will be magnetized. However, because of the difference in the coercivity of the shell 131 and the core 132, the shell 131 will maintain its polarity and will reverse the polarity of the core 132 when the magnetic field is removed. That is, once the shell 131 has been magnetized, and in the absence of an external magnetic field, the axial shell field overcomes whatever magnetization the core may have had. Flux lines from the shell close back through the core and the total external field of the wire, as caused by the combination of the shell and the core, is almost negligible.

Considering now more specifically the bi-stable wire 130 situated between the pole faces 115 and 116, as illustrated in FIG. 2, it will be seen that the wire 130 is in a magnetic field comprising two components; a first magnetic flux from left to right and illustrated schematically as **111*f* in FIG. 3 and which is derived from permanent magnet 111; and another flux in the opposite direction and illustrated schematically as 112*f* produced by the permanent magnet 112. The sum of the magnetic flux 111*f* and 112*f* results in a relatively weak magnetic flux from left to right. For the present discussion, it will be assumed that the wire 130 has been previously magnetized so that the shell 131 tends to produce flux lines 131*f*, FIG. 3, which are in opposite to the resultant flux of the combination of 111*f* and 112*f*. The resultant flux of the combination of 111*f* and 112*f* is designed to be below a threshold value which could reverse the magnetism of the shell 131. However, the core 132, having a relatively low coercivity, will have magnetic flux lines 132*f* which are in the same direction as the resultant flux of the combination 111*f* and 112*f*. That is, the flux 132*f* will be in a direction which is opposite to the direction of flux 131*f* and which is in the same direction as flux 111*f*, inasmuch as the flux 111*f* dominates the flux 112*f***.

A moments reflection will reveal that FIG. 3 illustrates the conditions which prevail in FIG. 2 when no wheel 102 is present in the space 122. That is, when no wheel 102 is near the detector 100, the flux **111*f* dominates the flux 112*f* and a flux in the dominant direction passes through the core 132 of the bi-stable wire 130**.

Considering now more specifically FIG. 4, it will be seen that there is illustrated therein the situation which prevails while a wheel 102 is in the space 122 and which serves to shunt a substantial portion of the flux produced by magnet 111. Accordingly, as viewed in FIG. 4, the flux attributable to magnet 111 which flows between the pole faces 115 and 116 is greatly reduced and is illustrated by the line **111*f'* of FIG. 4. The magnitude of the flux generated by the magnet 112 is not significantly altered by the presence of the wheel and the magnitude of this flux is illustrated in FIG. 4 by flux line 112*f*. It wil be apparent that when the wheel 102 is present in the space 122, the magnetic flux 112*f* will dominate the flux 111*f'*. Because the core 132 of the wire 130 has a relatively low coercivity, the flux in the core 132 will be aligned with the dominant flux between the pole faces 115 and 116. In summary, it will be seen that the flux in the core 132 will correspond in direction with the dominant flux between the pole faces 115 and 116**.

Returning to FIG. 2, it will be recalled that a sensing coil 128 is wound on, or in coupling relationship with, the wire 130. The sensing coil 128 may comprise from several hundred to a few thousand turns of copper wire. The sensing coil 128 may be wrapped around the wire 130 or in close proximity thereto and is little, if any, affected by the resultant magnetic field of the flux **111*f* and 112*f*. However, it is a well known principle that if a magnetic flux changes in the presence of a conducting coil, the time change in flux linkage induces a voltage in the coil. This basic concept is used in any number of electric devices including transformers, motors, generators, meters many other devices. Accordingly, it will be understood that in response to the reversal of the flux 132***f* in the core 132, a potential is induced in sensing coil 128. As shown in FIG. 2, the sensing coil 128 may be connected to control apparatus 129 which responds to the induced voltage for initiating any desired actuation such as operating a counter or other control or alarm signal.

In an actual application, the flux density between the pole faces 115 and 116, when no wheel is present, may be of the order of 20 to 30 Gauss. When a wheel is present, the flux density between the pole faces 115 and 116 may be of the order of 40 to 100 Gauss and in a direction opposite to that when no wheel is present.

An important characteristic of the structure which increases its utility, in the described railroad environment, is the fact that reversing the magnetic core 132 takes a substantially constant time and is triggered by the driving field attaining a critical threshold level. The rate at which the driving field changes is irrelevant. Accordingly, the velocity of the wheel 102 as it enters the space 122 is irrelevant and the same output signal is obtained by the control device 129 irrespective of the wheel velocity. It will also be apparent that for the configuration of FIG. 2, the wheel may approach the detector from either the left or the right and produce similar output signals. It will be understood that an output signal is produced by the sensing coil 128 in response to both the entrance and the exit of the wheel 102 and that the entrance and exit signals have opposite polarities.

In the art of railroad switching and control, it is often desirable to implement a structure which includes a wide variety of safeguards to assure that an unsafe operation cannot take place. The structure as thus far described may be modified in the manner to be described to provide an embodiment suitable for vital, or fail-safe, implementation. By adding a separate winding 140 on pole piece 113 and which is connected to an alternating current power supply 141 which has an appropriate frequency and magnitude, there will be produced an alternating flux in the pole pieces 113 and 114 such that the net flux across the pole faces 115 and 116 is being continuously reversed. Thus, the introduction of the winding 140 will result in a continuous stream of output signals from the sensing coil 128 and the control circuit 129 may be designed to respond to a cessation of the stream of output signals from sensing coil 128 to indicate system failure. With the system of FIG. 2 modified by the addition of the winding 140, it will be apparent that the presence of the wheel 102 in the space 122 will still shunt the permanent magnet 111 which will result in a shift of the average magnetic field and, therefore, a cessation of the stream of output signals from sensing coil 128. The control circuit 129 may be designed to time the duration of cessation of the stream of output signals from sensing coil 128 and, so long as the cessation does not extend beyond a predetermined time limit, the control circuit 129 will interpret the cessation of control signals from sensing coil 128 to represent the presence of a wheel 102 in the space 122. However, if the wheel 102 does not continue to move and thereby allow the resumption of the stream of output signals from sensing coil 128, a failure signal may be indicated. This means that a train which stops with the wheel 102 in the space 122 may ultimately cause a failure signal because of the extended duration of the cessation of the stream of output signals from the sensing coil 128. Such action is in harmony with the philosophy of railroad circuit design. Accordingly, there has been shown a modified circuit which allows constant monitoring, or supervision, to assure the proper functioning thereof.

It will, of course, be understood that the magnitude of the a.c. power supply 141 and the number of turns on the winding 140 will influence the magnitude of the magnetic flux generated by the winding 140 and that the relative magnitudes of all fluxes must be carefully coordinated to provide the desired results. That is, if the magnitude of the flux produced by the winding 140 is too small, a continuous stream of output signals will not be produced by the sensing coil 128 and, conversely, if the magnitude of the flux generated by the winding 140 is too large, the stream of output signals from the sensing coil 128 will not be terminated in response to the presence of a wheel 102 in the space 122.

It may be readily understood that situations will arise wherein it would be desirable for the detector 100 to be able to sense not only the passage of a wheel through the detector 100, but also to be able to provide signals indicative of the direction of motion of the wheel. FIG. 5 discloses an embodiment of the invention which provides this facility, namely output signals indicative of the direction of motion of the train as it passes the detector position. For convenience, elements of the structure shown in FIG. 5 which have a close correspondence to elements in FIG. 2 have been given identification numerals which correspond with those of FIG. 2, except for a different first digit.

Considering now more specifically FIG. 5, there will be seen a sketch which illustrates in symbollic and simplified form the structure, assembly and essential electrical and magnetic elements of another embodiment of the invention. It will be understood that for the most part housing and support members which do not need to be shown for an understanding of the invention have been omitted in order to simplify the drawing and avoid obscuring the inventive concept. In FIG. 5, there is shown the detector 200 which is supported on or near a rail 201. The detector is coupled to the web of the rail 201 by an optional support bar 250 which is bolted to the rail 201 by bolts 251. It should be understood that the elements of FIG. 5 are drawn and illustrated in a maner to simplify understanding the concept of the structure and that the actual configuration and proportions are not illustrated. The detector 200 includes first and second permanent magnets 211 and 212 which have a general "J" shape with the longer leg coupled to the support member 250 or the web of the rail 201 and the shorter leg brought up to the proximity of the track 201. Member 250, or the rail web, serves as a pole piece. A pole piece 213 may also be used. Accordingly, it may be seen that magnetic flux emanating from the north pole of magnet 211 will travel from left to right through pole piece 250 and through permanent magnet 212 from the south pole to the north pole thereof and thence through air and/or the rail 201 and/or pole piece 213, if used, from right to left and return to the south pole of magnet 211. The major flux will be concentrated in the described ferromagnetic circuit. However, it should be understood that a magnetic field is present in adjacent areas. In addition to the permanent magnets 211 and 212, the detector includes ferromagnetic members 220 and 221 which are coupled respectively to support member 250 and pole piece 213 and include pole faces 216 and 215 which face each other across an air gap 217. If the magnets 211 and 212 have nearly equal magnetic strength, the pole piece 221 is centered, and the member 213 has uniform reluctance, little, if any, magnetic flux will flow through members 220 and 221. If the foregoing conditions do not apply, adjustments may be made by adding a small air gap or nonmagnetic shim at 218 or 219 between the magnets 212 and 211, respectively, and the pole piece 213 and/or by other mechanical adjustments. With this adjustment, the net magnetic flux in the members 220 and 221 and hence in the air gap 217 may be reduced to a very small value.

It will be seen that the pole piece 213 is situated parallel to, but spaced apart from, the rail 201. The separation between the pole piece 213 and the rail 201 is represented by the space 222 and has sufficient width to accommodate the flange 202' of a train wheel 202 as it moves along the rail 201. Accordingly, it will be seen that if a train wheel 202 enters the detector 200 from right to left, the flange 202' will be interposed between the pole piece 213 and the rail 201. Since the flange 202' is made of ferromagnetic material, at least some of the flux which had circulated in the magnetic bridge circuit previously described will be diverted into the flange 202' and the rail 201. As a consequence, some magnetic flux will flow in the members 220 and 221 and across the air gap 217. That is, the wheel 202 will unbalance the magnetic bridge. As the wheel 202 advances through the detector 200, the flange 202' will move from the proximity of the magnet 212 to the proximity of the magnet 211 and at this point, the magnetic bridge circuit originally described will again be unbalanced and a magnetic flux will flow in the members 220 and 221 and across the air gap 217. It will be appreciated that when the flange 202' is at one end of the detector 200, the direction of the flux across the air gap 217 will be in one direction and that when the flange 202' moves to the other end of the detector 200, the direction of the flux across the air gap 217 will be in the other direction. It will therefore be apparent that at some intermediate point, the flux in the air gap 217 is zero.

In summary, the structure is designed so that with no wheel 202 present in the detector 200, there is minimal, if any, magnetic flux across the air gap 217. When a wheel 202 enters the detector 200, the magnetic bridge circuit is disturbed and there is a net flux across the air gap 217 in a predetermined direction. As the wheel 202 advances through the detector, the flux in the air gap 217 is reduced to zero and as the wheel 202 advances to the other end of the detector 200, the flux in the air gap 217 flows in a sense opposite to that created when the wheel 202 first entered the detector. Focusing attention even more specifically on air gap 217, it must be appreciated that in the standby condition, there is minimal, if any, flux in the air gap 217. However, as a wheel 202 enters the detector, magnetic flux in a first direction passes through the air gap 217; and when the wheel is at an intermediate point, the air gap flux is reduced to zero; and as the wheel continues through the detector 200, flux is generated in the air gap 217 in an opposite direction, and finally when the wheel 202 exits from the detector 200 the air gap flux returns to its original near zero value.

It should be appreciated that if the wheel 202 enters the detector 200 in a first direction, the initial magnetic flux in the air gap 217 between pole faces 215 and 216 will be in a first direction; and if the wheel 202 enters the detector 200 from the opposite direction, the initial net magnetic flux between the pole faces 215 and 216 will be in an opposite direction. Accordingly, it will be appreciated that the direction of the magnetic flux between the pole faces 215 and 216 is indicative of the direction of the passage of the wheel 202 through the detector 200.

Attention is now drawn to the fact that a bi-stable ferromagnetic wire 230 having a characteristic similar to that previously described, with respect to bi-stable wire 130 of FIG. 2, is situated in the air gap 217. The bi-stable wire 230 includes an outer shell 231 and a core 232 of relatively high and low coercivity, respectively. Wound on, or in coupling relationship with, the bi-stable wire 230 is a sensing coil 228 which is coupled to a control circuit 229.

If the wheel approaching the detector 200 approaches from left to right, the wheel on track 201 will, as it enters the detector 200, shunt a portion of the flux from magnet 211 and thereby unbalance the magnetic bridge and cause a significant increase in the net flux in the air gap 217 which will pass through the bi-stable wire 230. As the wheel exits the detector 200, it will be seen that a portion of the magnetic flux generated by the magnet 212 would be shunted and that the flux through the air gap 217 will be opposite to the flux produced as the wheel entered the detector. Accordingly, a net magnetic flux in one direction is generated in the gap 217 when the train wheel 202 enters and a net magnetic flux of opposite direction is produced in the air gap 217 when the train wheel 202 exits. Similar flux changes, but in the opposite sequence, are generated in air gap 217 when the wheel 202 enters the detector from right to left. In either case, the reversal of the flux in the air gap 217, as the wheel 202 passes through the detector 200, will affect the bi-stable wire 230 and cause the production of a pulse at the output terminals of the sensing wire 228. It will be evident that the output pulse from the sensing coil 228 will have first and second polarities when the wheel 202 passes through the detector 200 in first and second directions.

Considering now more specifically the characteristics of the bi-stable wire 230 and, in particular, how it functions in the magnetic bridge of FIG. 5, it should be recalled that the shell 231 has a higher coercivity than the core 232. The magnitude of the flux in the air gap 217, when the magnetic bridge is unbalanced, is such as to magnetize the shell 231. And subsequently, when the flux in the air gap 217 is reduced to zero, the high coercive shell 231 captures the core 232 and reverses the direction of flux therein. Accordingly, as successive wheels of a train enter the detector 200, it will be seen that the second and successive wheels will cause a first core flux reversal when the wheel is at the approximate midpoint of the detector 200 and a second core flux reversal as the wheel exits the detector. Accordingly, the sensing coil 228 will produce a pair of output pulses for each wheel, after the first, passing through the detector and that the pulses have opposite polarity. Furthermore, analysis will show that when the wheels are passing through the detector 200 in one direction, the pairs of pulses will have first and second polarity in that order and that when wheels are passing through the detector in the opposite direction, the pulse pairs will have second and first polarity in that sequence. Accordingly, the control circuit 229 may be designed to be sensitive to the polarity of the input pulses and determine their sequence which, in turn, determines the direction of motion of the train.

It will be observed that each wheel passing through the detector 200 produces a pair of pulses. The overall size of the detector 200 will depend upon a variety of factors, but the total length will usually fall within the range of 6 to 18" or thereabout. Since even the most closely spaced wheels of a train are more widely separated than this, it follows that the closest pulses of adjacent pairs are more widely separated than the pulses of each pair and, therefore, well known techniques may be used in the control circuit 229 to identify pulse pairs and, hence, the direction of motion of the train through the detector 200. Furthermore, the control circuit 229 could be designed to include techniques for timing the interval between pulse pairs and thereby determine the average velocity of the train passing through the detector 200.

To summarize, and phrase differently, it will be appreciated that when a wheel passes through the detector 200 in a first direction, a pair of pulses having first and second polarities will appear across sensing coil 228; and when a wheel passes through the detector 200 in an opposite direction, a pair of pulses having second and first polarities will appear across the sensing coil 228. Accordingly, by coupling a suitable control circuit 229 to the sensing coil 228, it is possible to determine whether the pulse pairs appear in one or another sequence and thereby determine the direction of the wheel as it passes through the detector 200. That is, the detector 200 is capable of providing information indicative of wheel passage as well as direction of passage.

If the detector 200 is to be used in an application with fail-safe requirements, an additional winding 240 may be wound in coupling relationship with the bi-stable wire 230, or with one of the pole pieces 220, 221, and connected to a source of a.c. power 241. The number of turns on the winding 240 and the potential of the power supply 241 may be adjusted such that in the absence of a wheel in the detector 200, the magnetic flux in the core of the bi-stable wire 230 is reversed at a rate proportional to the frequency of the a.c. power supply 241 so that a constant stream of output pulses of first one and then the other polarity are generated in the sensing coil 228. With this modification, the control circuit 229 will be designed to interpret a continuous stream of pulses from the sensing coil 228 as indicative of the absence of a train wheel in the detector 200. If the potential of the alternating current supply 241 is adjusted to develop a flux which is only slightly greater than the threshold of the bi-stable wire 230, then an unbalance of the magnetic bridge will shift the net applied field in the air gap 217 so that the flux fails to exceed the threshold in one of the positive or negative directions. This will prevent flux reversal of the core 232 and total cessation of the pulses from sensing coil 228. Therefore, when a wheel enters the detector 200 the positive and negative output pulses of the sensing coil 228 will be terminated. The direction of the flux in the air gap 217 will be determined by the direction of wheel entry and, in turn, the direction of the air gap flux will determine the polarity of the final pulse of the pulse stream from sensing coil 228. As the wheel 202 passes through the detector 200, the pulse stream will resume while the wheel is at, or near, the midpoint. Then the pulse stream will again be interrupted as the wheel 202 exits the detector 200 and again unbalance the magnetic bridge. After wheel exit, the magnetic circuit is again balanced and the pulse stream resumes.

As previously mentioned, the last pulse of the pulse stream before cessation is indicative of direction of wheel motion. Accordingly, the control circuit 229 can be designed to remember the polarity of the last pulse and provide a signal indicative of train direction. And, if the control circuit 229 includes means for measuring the duration of pulse cessation, the control circuit can provide a signal indicative of train velocity.

A wide variety of magnetic circuits can be designed which will provide the necessary characteristics. The magnetic circuit must include an air gap across which the flux density and/or direction can be controlled or altered in response to the passing of a ferromagnetic member such as a train wheel. In FIG. 5, if a magnetic member 213 is used, the wheel tends to shunt some of the flux and thereby cause a flux change in control air gap 217. If the member 213 is omitted, or is non-magnetic, the wheel will tend to concentrate the flux in the magnetic structure and hence in the control air gap 217. In either case, the flux in air gap 217 is controlled or altered.

Another suitable magnetic circuit could be arranged along a rail which would look like an "E" on its back and having an air gap in each half of the back and a control air gap in the central bar member. The bi-stable wire would be placed in the control air gap of the central bar member. The two end members would constitute permanent magnets which are oppositely poled. In the absence of a train wheel, the members would be adjusted for negligible flux in the control air gap. With the ends of the bar members situated to be proximate to the wheel as it passes, it will be obvious that the wheel will greatly reduce the reluctance between adjacent bar members and thereby cause a flux concentration in the control gap. Because the permanent magnets are poled differently, a flux of opposite direction will be concentrated in the control gap when the wheel is in position to reduce the reluctance between the other pair of adjacent bar members.

The described "E" structure may be oriented with the bars vertical to sense the lower edge of the flange 202'; or in a horizontal orientation to sense the side of the wheel 202. Other configurations will occur to proficient designers.

While there has been shown and described what is considered at the present to be a preferred embodiment of the invention, modification thereto will readily occur to those skilled in the related arts. For example, electromagnets could be substituted for permanent magnets, the a.c. driving coil could be situated on a different member, or a plurality of bi-stable ferromagnetic wires could be provided. It is believed that no further analysis or description is required and that the foregoing so fully reveals the gist of the present invention that those skilled in the applicable arts can adapt it to meet the exigencies of their specific requirements. It is not desired, therefore, that the invention be limited to the embodiments shown and described, and it is intended to cover in the appended claims all such modifications as fall within the true spirit and scope of the invention.

What is claimed is:

1. In a detector of the class wherein the presence of a member having magnetic properties alters a magnetic circuit such that there is a change in the magnetic flux between the faces of opposing pole pieces of the magnetic circuit, the combination with said structure of:

(a) a bi-stable ferromagnetic device situated between the faces of the pole pieces, said device having a core portion and an outer shell portion of relatively low and high coercivity, respectively;

(b) said change of magnetic flux being effective for reversing the polarity of said low coercive core;

(c) a sensing coil in coupling relationship with said bi-stable ferromagnetic device for responding to the flux change resulting from the reversal of the polarity of said core by producing an output signal; and (d) a separate winding coupled to one of said pole pieces and connected to a source of a.c. potential of sufficient magnitude that the magnetic flux between said faces of the opposing pole pieces reverses direction at a rate proportional to the frequency of the a.c. potential for causing said sending coil to produce output signals in response to each flux reversal.

2. The combination as set forth in claim 1, wherein the output signals of said sensing coil are produced only while the member is not in position to affect the flux between the faces of the pole pieces.

3. The combination as set forth in claim 1, wherein the output signals of said sensing coil are not produced while the member is in position to affect the flux between the faces of the pole pieces.

4. The combination as set forth in claim 1, wherein the member comprises a ferromagnetic railroad wheel rolling on a ferromagnetic rail and wherein the magnetic circuit may include a portion of said ferromagnetic rail.

5. In a system for railroad wheel detection of the class wherein the entrance and exit of a ferromagnetic railroad wheel alters a magnetic circuit and changes the direction of the magnetic flux between the faces of opposing pole pieces, the combination with said structure of:

(a) a bi-stable ferromagnetic device having a core portion and an outer shell portion of relatively low and high coercivity, respectively, situated between the faces of the opposing pole pieces;

(b) said magnetic flux, when said magnetic circuit is altered, being effective to alter the magnitude and/or magnetic polarity of said low coercive core;

(c) a sensing coil in coupling relationship with said bi-stable ferromagnetic device for producing an output pulse in response to each magnetic polarity reversal of said core and (d) wherein said sensing coil produces first and second output pulses in response to the entrance and exit, respectively, of the railroad wheel in said detection system.

6. The combination as set forth in claim 5, wherein said first and second output pulses are electrically distinguishable.

7. The combination as set forth in claim 6, wherein said first and second pulses are produced in said named sequence when the railroad wheel passes through said system in one direction and wherein said first and second pulses are produced in a reversed sequence when the railroad wheel passes through the system in a reverse direction.

8. A motion and direction sensing system comprising in combination:

(a) a control air gap in a magnetic circuit arranged and oriented with respect to the path of a moving magnetic member for sequentially producing a first and second flux flow in first and second directions in said control air gap in response to the motion of said magnetic member along the path;

(b) a bi-stable ferromagnetic device having a core portion and a shell portion of relatively low and high coercivity, respectively, situated in said control air gap for responding to said flux flow in said control air gap; and (c) a sensing coil in coupling relationship with said bi-stable ferromagnetic device for producing first and second output pulses of first and second polarities, respectively, in response to a change of direction of flux in said core.

9. The combination as set forth in claim 8, wherein said flux flow is produced sequentially in said first and second directions and in said second and first directions when said magnetic member moves in first and second directions, respectively, with respect to said system.

10. The combination as set forth in claim 9, wherein said sensing coil sequentially produces output pulses of said first and second polarity and of said second and first polarity as said magnetic member moves in first and second directions, respectively, with respect to said system.

11. A motion detection system comprising in combination:

(a) a magnetic circuit including a control air gap;

(b) circuit means coupled to said magnetic circuit for alternately producing a flux of first and second opposing directions in said control air gap;

(c) a bi-stable ferromagnetic device situated in said control air gap and having a core and shell portions of relatively low and high coercivity, respectively, with at least said core responding to the direction of the flux in said control air gap by becoming magnetically polarized in accordance with the direction of the flux in said control air gap;

(d) a sensing coil in coupling relationship with said ferromagnetic device for producing an output pulse in response to each reversal of magnetic polarity of said core; and (e) said magnetic circuit arranged and oriented with respect to the path of a moving magnetic member for altering the flux in said magnetic circuit and introducing a flux in a first direction in said control air gap of sufficient magnitude to terminate the production of flux reversals in said control air gap by said circuit means when said magnetic member is in a first predetermined relationship with respect to said magnetic circuit.

12. The combination as set forth in claim 11, wherein when said magnetic member is in a second predetermined relationship with respect to said magnetic circuit, a flux of a second direction is introduced in said control air gap which is of sufficient magnitude to terminate the production of flux reversals in said control air gap by said circuit means.

13. The combination as set forth in claim 12, wherein said magnetic member is sequentially in said first and second positions and second and first positions as it moves along its path in first and second directions, respectively.

14. The combination as set forth in claim 13, wherein said sensing coil produces output pulses of first and second polarity in response to the reversal of the magnetic polarity of said core from first to second and second to first polarities, respectively.

* * * * *